US006840897B2

(12) United States Patent
Knight

(10) Patent No.: US 6,840,897 B2
(45) Date of Patent: Jan. 11, 2005

(54) ZIPPER APPLICATOR

(75) Inventor: Nigel Knight, Kankakee, IL (US)

(73) Assignee: Illinois Tool Works Inc., Glenview, IL (US)

( * ) Notice: Subject to any disclaimer, the term of this patent is extended or adjusted under 35 U.S.C. 154(b) by 85 days.

(21) Appl. No.: 10/198,313

(22) Filed: Jul. 18, 2002

(65) Prior Publication Data

US 2004/0014578 A1 Jan. 22, 2004

(51) Int. Cl.[7] ..... B31B 1/68

(52) U.S. Cl. ..... 493/383; 493/213; 493/214; 493/927; 53/133.4; 53/139.2

(58) Field of Search ..... 493/383, 211, 493/213, 214, 927; 53/412, 133.4, 139.2

(56) References Cited

U.S. PATENT DOCUMENTS 4,355,494 A * 10/1982 Tilman ..... 53/139.2
4,709,533 A * 12/1987 Ausnit ..... 53/139.2
4,812,074 A * 3/1989 Ausnit et al. ..... 493/927
4,909,017 A * 3/1990 McMahon et al. ..... 53/139.2
5,400,568 A * 3/1995 Kanemitsu et al. ..... 53/139.2
6,044,621 A * 4/2000 Malin et al. ..... 493/927
6,099,451 A * 8/2000 Mulder et al. ..... 53/139.2
6,131,370 A * 10/2000 Ausnit ..... 493/927
6,350,340 B1 * 2/2002 Johnson ..... 53/139.2
6,553,740 B2 * 4/2003 Delisle ..... 53/133.4
6,640,519 B1 * 11/2003 Goodwin ..... 53/133.4
6,656,297 B2 * 12/2003 Schneider et al. ..... 493/927

* cited by examiner

*Primary Examiner*—Louis Huynh
(74) *Attorney, Agent, or Firm*—Pitney Hardin LLP

(57) ABSTRACT

An apparatus and method for engaging both profiles (18, 20) of an interlocked zipper (12) as the zipper or fastener strip is guided onto a supply of thermoplastic film (16) used to make a reclosable bag. A first interlocked profile (18) of the zipper is engaged by at least one roller (24, 26, 36, 38, 40, 42, 44) of the roller-type applicator (10). A disc (28) mechanically attached to an end section of at least one of the rollers engages a web (22) of the second interlocked profile (20) that extends beyond the width of a web of the first profile (18). By their attachment, the disc (28) and the roller move the profiles (18, 20) at the same speed so that the profiles remain aligned as they are moved through the zipper guide (14). The zipper (12) is then attached to a surface of the thermoplastic film (16) used to make the reclosable bag.

10 Claims, 4 Drawing Sheets

ZIPPER APPLICATOR

BACKGROUND OF THE INVENTION

1. Field of the Invention

The present invention relates to the application of zippers to film used to make reclosable plastic bags. More specifically, the present invention relates to a roller-type zipper applicator with a zipper guide in which a disc with a circumference greater than at least one of the rollers of the applicator is positioned on the end of the roller with the smaller circumference.

2. Description of the Prior Art

The present invention relates to improvements in the package-making art and may be practiced in the manufacture of reclosable thermoplastic bags and packages of the type that may be used for various consumer products. Such packages often include a form of peel-seal to render the package moisture and/or airtight prior to the initial opening and/or as a tamper-evident seal. A zipper means protects any remainder of the product therein after the initial opening.

The indicated art is fairly well developed but nevertheless remains open to improvements contributing to increased efficiency and cost-effectiveness in the package-making art. In the prior art, McMahon et al. (U.S. Pat. No. 4,909,017) discloses a method of making a form-fill bag having a reclosable fastener. Prior to entering a form-fill and seal (FFS) machine, fastener strips are attached to the surface of the film at bag length intervals transverse to the running direction of the film. The fastener strips contain pre-joined interlocked rib and groove strips. Only one of the strips is attached to a top surface of the film, with the other strip facing upwardly or, in other words, inwardly toward the interior of the bag to be formed. The attached strips are secured at the center of the film and each strip is less than half of the film's width. The film is then advanced to the FFS machine and drawn over a forming collar and about the filling tube, with the longitudinal side edge margins of the film brought together and seamed with a fin seal to form a tube. Cross-seals are made across the tube to join the unattached fastener strip to form the top and bottom of the bag.

A problem is sometimes encountered during the attachment of the fastener or zipper to the film. Typically a roller-type zipper applicator engages one profile of the zipper and positions the zipper on the film used on the FFS machine. The other profile of the zipper is interlocked with the engaged profile and moves to be later attached to the film as a result of the profiles being interlocked. However, if the profiles are not securely interlocked or longitudinally slide against each other, the profiles may significantly misalign in relation to each other as the roller moves the profile on which it is engaged. This misalignment of the zipper profiles makes it difficult to properly seal the zipper to the film, resulting in a defective zipper after formation of the reclosable bag. An improvement in the zipper applicator would be the ability to engage both profiles with at least one or more rollers of the zipper applicator in order to calibrate the movement of both profiles to the movement of the rollers. The calibrated movement of both profiles would prevent the zipper profiles from misaligning with each other before attachment to the film used to make a reclosable bag.

SUMMARY OF THE INVENTION

Accordingly, the present invention relates to a zipper applicator that engages both profiles of an interlocked zipper as the zipper or fastener strip is guided onto a supply of thermoplastic film used to make a reclosable bag. Prior to attachment on the film, a length of interlocked zipper is separated from a continuous supply and is advanced by a roller-type zipper applicator on a zipper guide. A first interlocked profile of the zipper is engaged by at least one roller of the zipper applicator. A knurled or serrated disc, mechanically attached to an end section of at least one roller of the zipper applicator, engages a web of the second interlockable profile that extends beyond the width of the first profile. As a result of their attachment, the disc and the roller move the profiles at the same speed so that the profiles remain aligned as they are moved on the zipper guide. The length of zipper is then attached to a surface of the thermoplastic film used to make the reclosable bag. As an alternative to attaching a disc to the end of a roller, a roller of the zipper applicator that is stepped with an extending area may engage the extended web.

BRIEF DESCRIPTION OF THE DRAWINGS

Further objects and advantages of the invention will become apparent from the following description and claims taken in conjunction with the accompanying drawings, in which:

DETAILED DESCRIPTION OF THE PREFERRED EMBODIMENT

Figure 1:
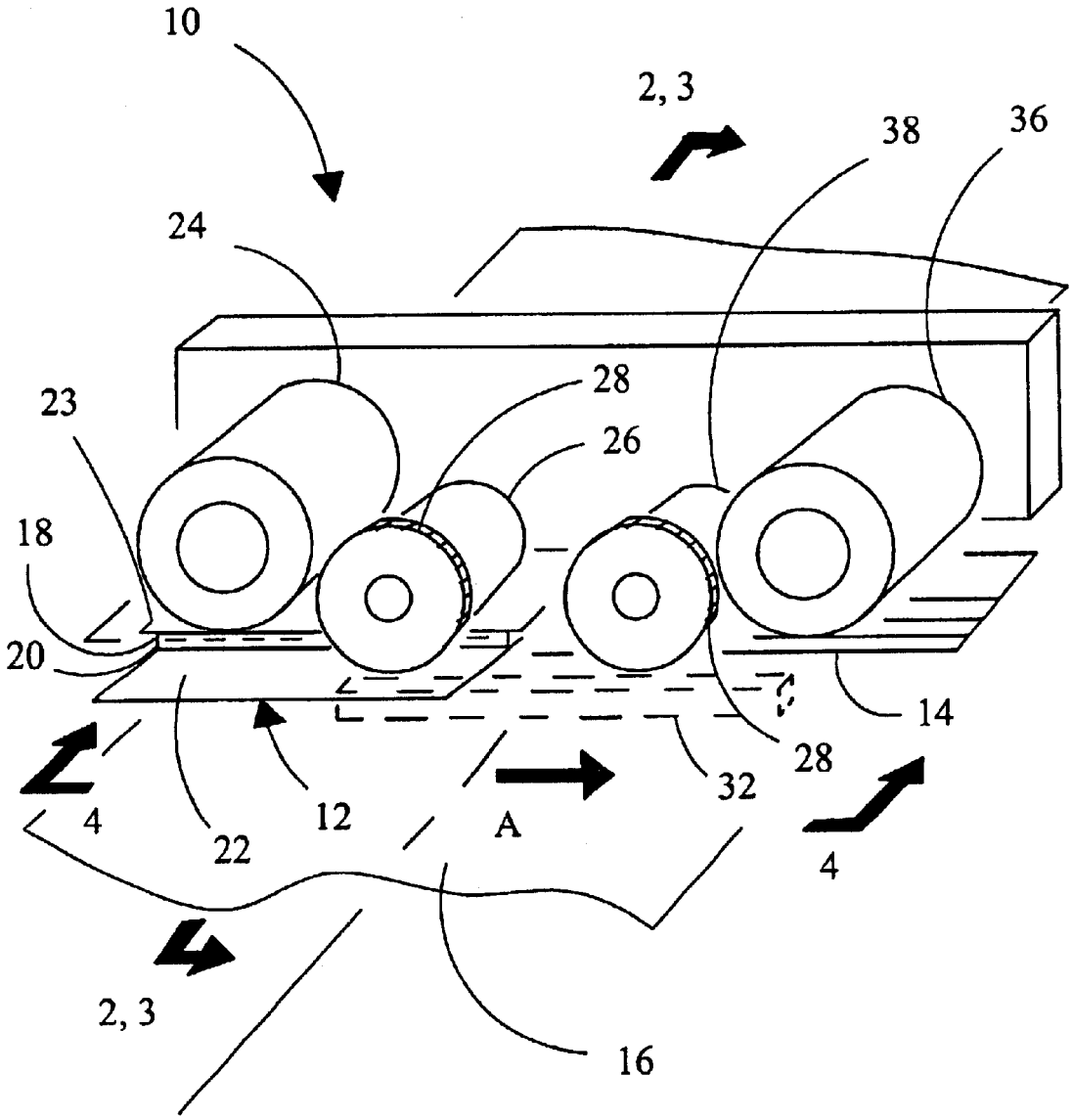
FIG. 1 is a perspective view of the zipper applicator of the present invention.

Referring now to the drawings in detail wherein like numerals indicate like elements throughout the several views, the zipper applicator 10 of the present invention is shown in FIG. 1. As shown in the figure, a zipper 12 is advanced on a zipper guide 14 of the zipper applicator in movement direction "A". The zipper is advanced and transversely fed to thermoplastic film 16 used to make a reclosable bag; however, the zipper may be fed to the film in other directions known to those skilled in the art. The zipper 12 that is preferably used with the zipper applicator 10 is of the type comprising two interlocked profiles 18, 20 in which an attaching web 22 of the profile 20 extends beyond the width of an attaching web 23 of the profile 18, with the width of the profiles being transverse to the longitudinal ends of the zipper.

Figure 2:
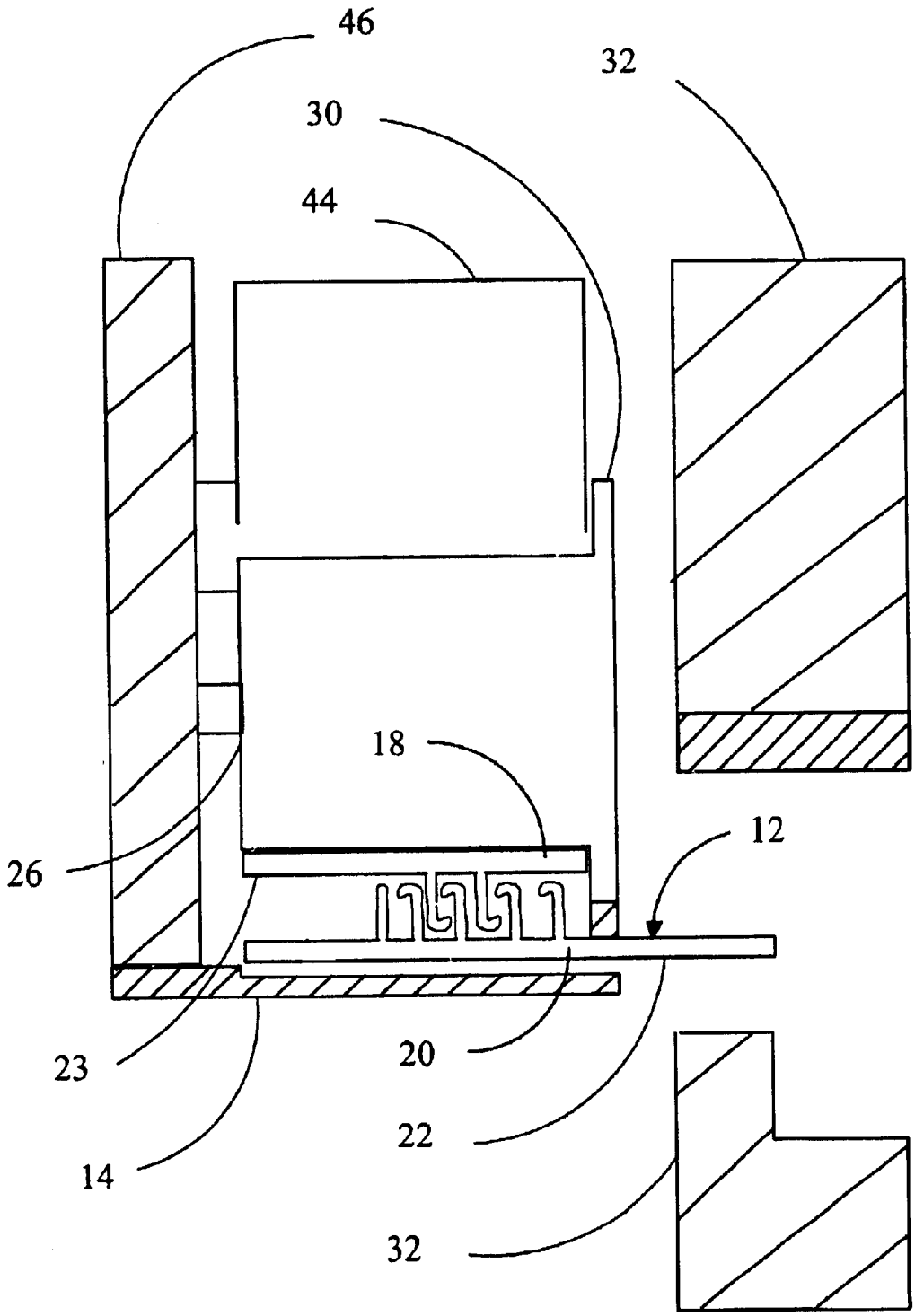
FIG. 2 is a sectional view taken from reference line 2—2 of FIG. 1 depicting the attachment of a disc to a roller of the zipper applicator of the present invention.

As the zipper 12 is advanced by the zipper applicator 10, a first roller 24 engages the profile 18 of the zipper and further advances the zipper until it is engaged by a second roller 26. The second roller 26 also engages web 23 of the profile 18 but additionally engages the web 22 of the second profile 20. Specifically, a disc 28 that is mechanically attached to an end section of the second roller 26 engages the web 22 by having a diameter larger than the diameter of the second roller. Preferably the disc 28 has a serrated, stainless steel surface that engages the web 22, with the disc having a diameter approximately one sixteenth of an inch greater than the diameter of the second roller 26. By its attachment to the second roller 26, the disk 28 and the second roller move both profiles 18, 20 at the same speed. The result is that the profiles 18, 20 remain aligned with each other as they are moved on the zipper guide 14 until the profiles are sealed to the film 16 by a sealing bar 32. Alternatively, and as shown in FIG. 2, the end section of the second roller 26 could include a stepped extending area 30 instead of the disc 28.

Figure 3:
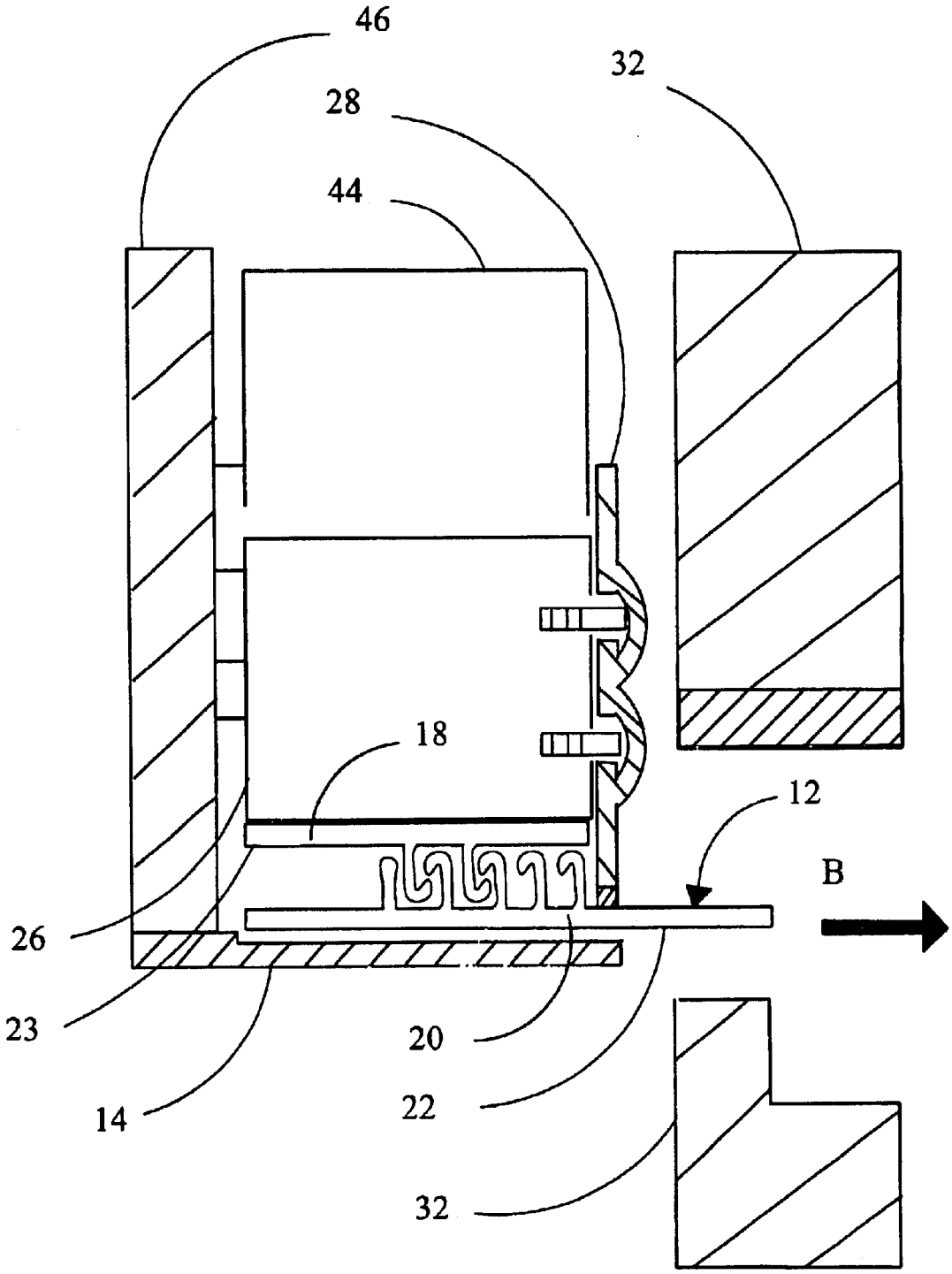
FIG. 3 is a sectional view taken from line 3—3 of FIG. 1 depicting an extending rubber area of the roller of the zipper applicator of the present invention.

In an alternative view of FIG. 3, the disc 28 directly engages the web 22 of the profile 20 while the second roller 26 of the web engages the web 23 of the profile 18. The disc 28 and the second roller 26 also reduce movement of the zipper 12 in direction "B" by engaging the profile 20. By reducing or eliminating movement in direction "B", the zipper stays further aligned on the zipper guide 14 and remains perpendicular to the movement of the film 16 during its attachment to the film.

Figure 4:
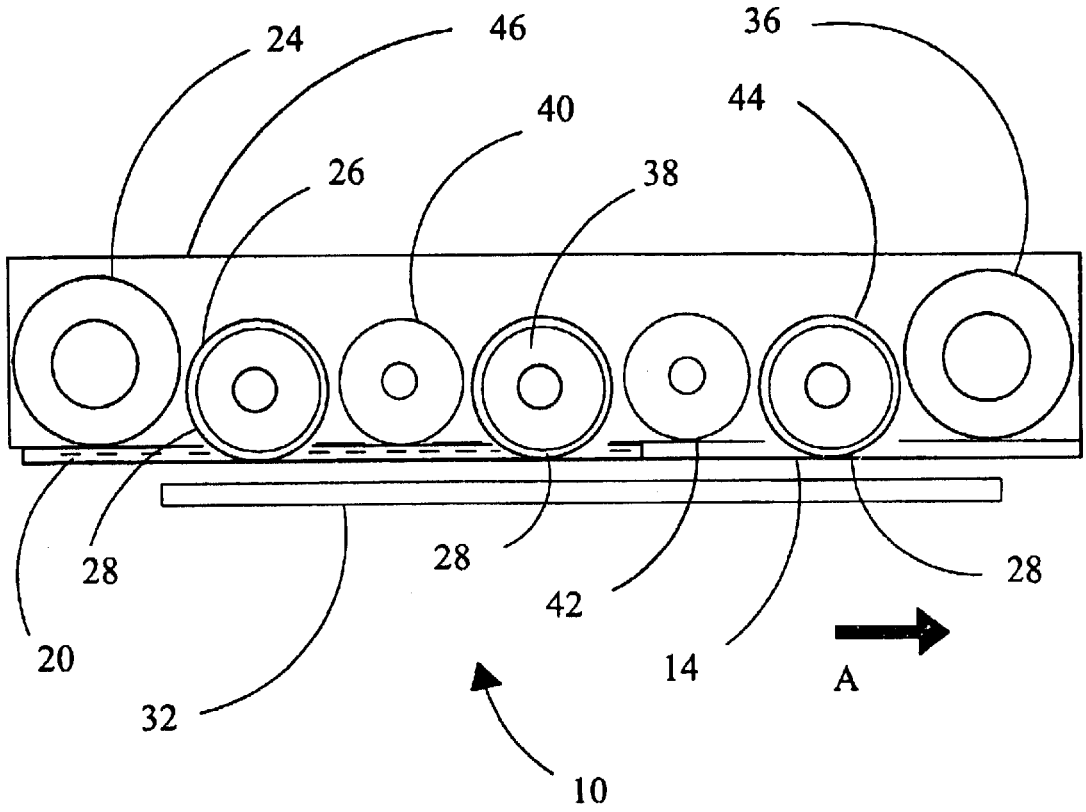
FIG. 4 is a sectional view taken from reference line 4—4 of FIG. 1 depicting a multi-roller arrangement of the zipper applicator of the present invention.

For the illustrative purposes of a perspective view of the zipper applicator 10 of FIG. 1, the zipper applicator comprises two rollers 24, 36 without attached discs, and two rollers 26, 38 with attached discs 28. Preferably, the zipper applicator 10 of the present invention has additional rollers 40, 42 and 44 with all of the identified rollers driven by a motor drive 46 as shown in the arrangement of FIG. 4. In FIG. 4, the rollers 24, 36, 40 and 42 do not have an attached disc 28 and the rollers 26, 38 and 44 have an attached disc 28.

Thus, the several aforementioned objects and advantages of the present invention are most effectively attained. Although preferred embodiments of the invention have been disclosed and described in detail herein, it should be understood that this invention is in no sense limited thereby and its scope is to be determined by that of the appended claims.

What is claimed is:

1. An apparatus for positioning a zipper for attachment to a film used to make a reclosable bag, said apparatus comprising:

a zipper guiding means to position the zipper for attachment on the film;

an engaging means for moving interlocking profiles of the zipper along said zipper guiding means; and wherein said engaging means includes a first and second set of motor driven rollers, wherein each roller of said second set of rollers includes a cylindrical body and an end section with a circumference greater than the circumference of said cylindrical body.

2. The apparatus in accordance with claim 1 wherein the apparatus further comprises a sealing means for attaching the positioned zipper to the film.

3. An apparatus for positioning a zipper for attachment to a film used to make a reclosable bag, the zipper having a first reclosable profile interlocked with a second reclosable profile, wherein the profiles contain at least one web extending substantially laterally from at least one side of each profile contained thereon with one web of the second profile extending beyond the lateral width of the first profile, said apparatus comprising:

a zipper guide for receiving and guiding the zipper separated from a continuous length of zipper;

a first set of motor driven rollers for moving the zipper guided by said zipper guide wherein each roller of said first set of rollers engages a web of the first profile when moving the zipper; and a second set of motor driven rollers for moving the zipper guided by said zipper guide in which each roller of said second set of rollers includes a cylindrical body and an end section with a circumference greater than the circumference of said cylindrical body, wherein said cylindrical body engages the web of the first profile and said end section engages the extending web of the second profile when moving the zipper on said zipper guide to position the zipper for attachment on the film.

4. The apparatus of claim 3 wherein said end section comprises a disc in which a face of the disc is attached to said cylindrical body.

5. The apparatus of claim 4 wherein the material of said disc is stainless steel.

6. The apparatus of claim 5 wherein the circumference of said end section is approximately one sixteenth of an inch greater than the circumference of said cylindrical body.

7. The apparatus of claim 4 wherein the circumference of said end section is approximately one sixteenth of an inch greater than the circumference of said cylindrical body.

8. The apparatus of claim 5 wherein said apparatus further includes a pair of opposed sealing bars for attaching the positioned zipper to the film.

9. The apparatus of claim 8 wherein the circumference of said end section is approximately one sixteenth of an inch greater than the circumference of said cylindrical body.

10. The apparatus of claim 3 wherein the circumference of said end section is one sixteenth of an inch greater than the circumference of said cylindrical body.

* * * * *